US010794169B2

(12) United States Patent
Gillan

(10) Patent No.: US 10,794,169 B2
(45) Date of Patent: Oct. 6, 2020

(54) SYSTEMS, DEVICES, AND METHODS FOR GENERATING DRILLING WINDOWS

(71) Applicant: Nabors Drilling Technologies USA, Inc., Houston, TX (US)

(72) Inventor: Colin Gillan, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 443 days.

(21) Appl. No.: 15/700,845

(22) Filed: Sep. 11, 2017

(65) Prior Publication Data

US 2019/0078425 A1 Mar. 14, 2019

(51) Int. Cl.

| | |
|---|---|
| ***E21B 44/00*** | (2006.01) |
| ***E21B 7/04*** | (2006.01) |
| ***E21B 47/04*** | (2012.01) |
| ***E21B 47/09*** | (2012.01) |
| ***E21B 47/06*** | (2012.01) |
| ***E21B 47/024*** | (2006.01) |
| ***E21B 41/00*** | (2006.01) |
| ***E21B 47/022*** | (2012.01) |

(52) U.S. Cl.

CPC ..... *E21B 44/00* (2013.01); *E21B 7/04* (2013.01); *E21B 41/0092* (2013.01); *E21B 44/005* (2013.01); *E21B 47/022* (2013.01); *E21B 47/024* (2013.01); *E21B 47/04* (2013.01); *E21B 47/06* (2013.01); *E21B 47/09* (2013.01)

(58) Field of Classification Search

CPC ..... E21B 44/00; E21B 44/005; E21B 7/04; E21B 47/022; E21B 47/04; E21B 47/024; E21B 47/06; E21B 47/09; E21B 41/0092

See application file for complete search history.

(56) References Cited

U.S. PATENT DOCUMENTS

| | | | | |
|---|---|---|---|---|
| 2014/0151121 | A1* | 6/2014 | Boone | E21B 44/02 175/27 |
| 2015/0233229 | A1* | 8/2015 | Benson | E21B 47/06 700/275 |
| 2016/0123134 | A1* | 5/2016 | Viens | E21B 7/04 175/45 |
| 2016/0237805 | A1* | 8/2016 | Gosney | E21B 19/16 |

* cited by examiner

*Primary Examiner* — Gregory J Toatley, Jr.
*Assistant Examiner* — Lynda Dinh
(74) *Attorney, Agent, or Firm* — Haynes and Boone, LLP

(57) ABSTRACT

Systems, devices, and methods for visualizing and steering a drilling apparatus are provided, including a drill string with a bottom hole assembly (BHA), a sensor system, and a controller operable to generate a visualization comprising one or more drilling windows representing drilling tolerances of a drill plan of the drilling operation and a depiction of a location of the BHA based on the one or more measurable parameters of the drilled wellbore. The differences between the location of the BHA and the one or more drilling windows may also be visualized. This visualization may be used by an operator to steer the drilled wellbore.

18 Claims, 9 Drawing Sheets

700

| Window Start at Plan MD | Width | Height | Offset –L/+R | Offset: from Plan –U/+D | Offset: from Last Window –U/+D | TVD Absolute | VS Absolute | Inclination Angle | Dip Angle | Comments |
|---|---|---|---|---|---|---|---|---|---|---|
| 15200 (c) | 60 | 30 | | -5 | | | | 88.1 | 1.9 | Window offset 5' up from plan line |

WINDOW OFFSET AND TILT ANGLE AFTER SECOND NEW DIP ANGLE AT DEPTH (D)

SYSTEMS, DEVICES, AND METHODS FOR GENERATING DRILLING WINDOWS

TECHNICAL FIELD

The present disclosure is directed to systems, devices, and methods for generating drilling windows for a drilling operation. The drilling windows may be used to visualize, direct, and track the performance of a drilling operation, which may be used to make improvements in the operation.

BACKGROUND OF THE DISCLOSURE

At the outset of a drilling operation, drillers typically establish a drill plan that includes a target location and a drilling path to the target location. Once drilling commences, the bottom hole assembly (BHA) may be directed or "steered" from a vertical drilling path in any number of directions, to follow the proposed drill plan. For example, to recover an underground hydrocarbon deposit, a drill plan might include a vertical bore to a side of a reservoir containing the deposit, then a directional or horizontal bore that penetrates the deposit. The operator may then follow the plan by steering the BHA through the vertical and horizontal aspects in accordance with the plan. Some factors considered when developing drill plans may include minimizing the time required to drill a wellbore and/or accessing the largest amounts of oil or gas possible.

Drilling operations in horizontal or near-horizontal wellbores pose additional challenges for drillers. For example, accessing a deposit may require that a driller drill multiple horizontal wellbores in close proximity. In this case, the tolerances for drilling each wellbore may be very small, and may require a high level of expertise as well as disciplined navigation to avoid making costly mistakes. Even minor inaccuracies in measurement or steering can cause problems for the current drilling operation as well as successive operations.

Furthermore, existing performance measurement systems include only a rough estimate of how closely the driller has followed the drill plan. Some performance measurement systems are based on a cylindrical model around the drill plan that give a distance and a polar angle between the BHA and the drill plan. This data does not easily fit the proximity tolerances of a drill plan, which may set out a simple lateral and vertical distance from the drill plan. Furthermore, existing performance measurements are generally based on a single tolerance level for the entire drill plan and are not able to be changed as conditions along the drill plan change.

Thus, a more efficient, reliable, and intuitive method for steering a BHA and visualizing drilling tolerances and drilling performance is needed.

BRIEF SUMMARY OF THE INVENTION

The present disclosure introduces a method of directing the operation of a drilling system that may include: generating, with a controller, one or more drilling windows around a portion of a drill plan, each of the one or more drilling windows having an outer boundary; drilling with a bottom hole assembly comprising a bit disposed at an end of a drill string to create a drilled bore; receiving sensor data from one or more sensors adjacent to or carried on the bottom hole assembly; determining, with the controller, a position of the bottom hole assembly based on the received sensor data; determining, with the controller, whether the determined position of the bottom hole assembly is within the outer boundary of the one or more drilling windows; and displaying, on a display device, the position of the bottom hole assembly relative to the one or more drilling windows.

The method may further include using the position of the bottom hole assembly relative to the one or more drilling windows as a reference to change the position of the bottom hole assembly. The method may also include generating, with the controller, a corrective action to move the bottom hole assembly into the one or more drilling windows if the controller determines that the bottom hole assembly is not within the outer boundary of the one or more drilling windows. The method may also include generating, with the controller, a corrective action to move the bottom hole assembly into the one or more drilling windows if the controller determines that the bottom hole assembly is not within the outer boundary of the one or more drilling windows.

In some implementations, determining a position of the bottom hole assembly comprises determining an orientation of a toolface, the method further comprising displaying the position of the bit relative to the one or more drilling windows on a three-dimensional display. The method may include generating the one or more drilling windows with a three-dimensional extruded rectangle shape. In some implementations, the one or more drilling windows are generated to represent a drilling tolerance at the portion of the drill plan around which the one or more drilling windows are generated. The method may include calculating, with the controller, a number of instances that the bottom hole assembly is within the outer boundary of the one or more drilling windows along the drill plan. The method may also include displaying, with the display device, a key performance indicator comprising a percentage of distance that the bottom hole assembly is within the outer boundary of the one or more drilling windows along the drill plan.

A drilling apparatus is also provided that may include: a drill string comprising a plurality of tubulars and a BHA operable to perform a drilling operation; a sensor system configured to detect one or more measureable parameters of a drilled wellbore; a controller in communication with the sensor system, wherein the controller is operable to generate a visualization comprising one or more drilling windows representing drilling tolerances of a drill plan of the drilling operation and a depiction of a location of the drill string based on the one or more measurable parameters of the drilled wellbore; and a display device in communication with the controller, the display device configured to display to an operator a visualization comprising the depiction of the location of the drill string and the one or more drilling windows.

In some implementations, the one or more measureable parameters of the drilled wellbore comprise an inclination measurement, an azimuth measurement, a toolface angle, and a hole depth. The controller may be further operable to generate a three-dimensional depiction of the drill plan, wherein the visualization further comprises the depiction of the drill plan. The one or more drilling windows may have a three-dimensional extruded rectangle shape. The controller may be operable to calculate a number of instances that the drill string is within the one or more drilling windows throughout the drilling operation. The controller may be operable to calculate a key performance indicator (KPI) based on a length of the drilled wellbore within the one or more drilling windows compared to a total length of the drilled wellbore.

An apparatus for steering a bottom hole assembly (BHA) is also provided, including: a controller configured to receive data representing a drill plan of a drilling operation and measured parameters indicative of positional information of the BHA in a down hole environment, wherein the controller is operable to generate a three-dimensional depiction of a most recent BHA position based on the measured parameters indicative of positional information, wherein the controller is operable to generate one or more drilling windows indicative of drilling tolerances of the drill plan; and a display device in communication with the controller viewable by an operator, the display device configured to display a visualization comprising the three-dimensional depiction of the most recent BHA position, the three-dimensional depiction of the drill plan, and the one or more drilling windows.

In some implementations, the one or more drilling windows has a three-dimensional rectangular prism shape. The controller is operable to generate a three-dimensional depiction of the drill plan. The controller may be operable to compare the most recent BHA position and the one or more drilling windows and display a distance between the BHA position and the one or more drilling windows on the display device. The controller may be operable to calculate a number of instances that the BHA is positioned within the one or more drilling windows throughout the drilling operation. The controller may be operable to calculate a key performance indicator (KPI) based on a length of a wellbore drilled with the BHA that is within the one or more drilling windows compared to a total length of the wellbore.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
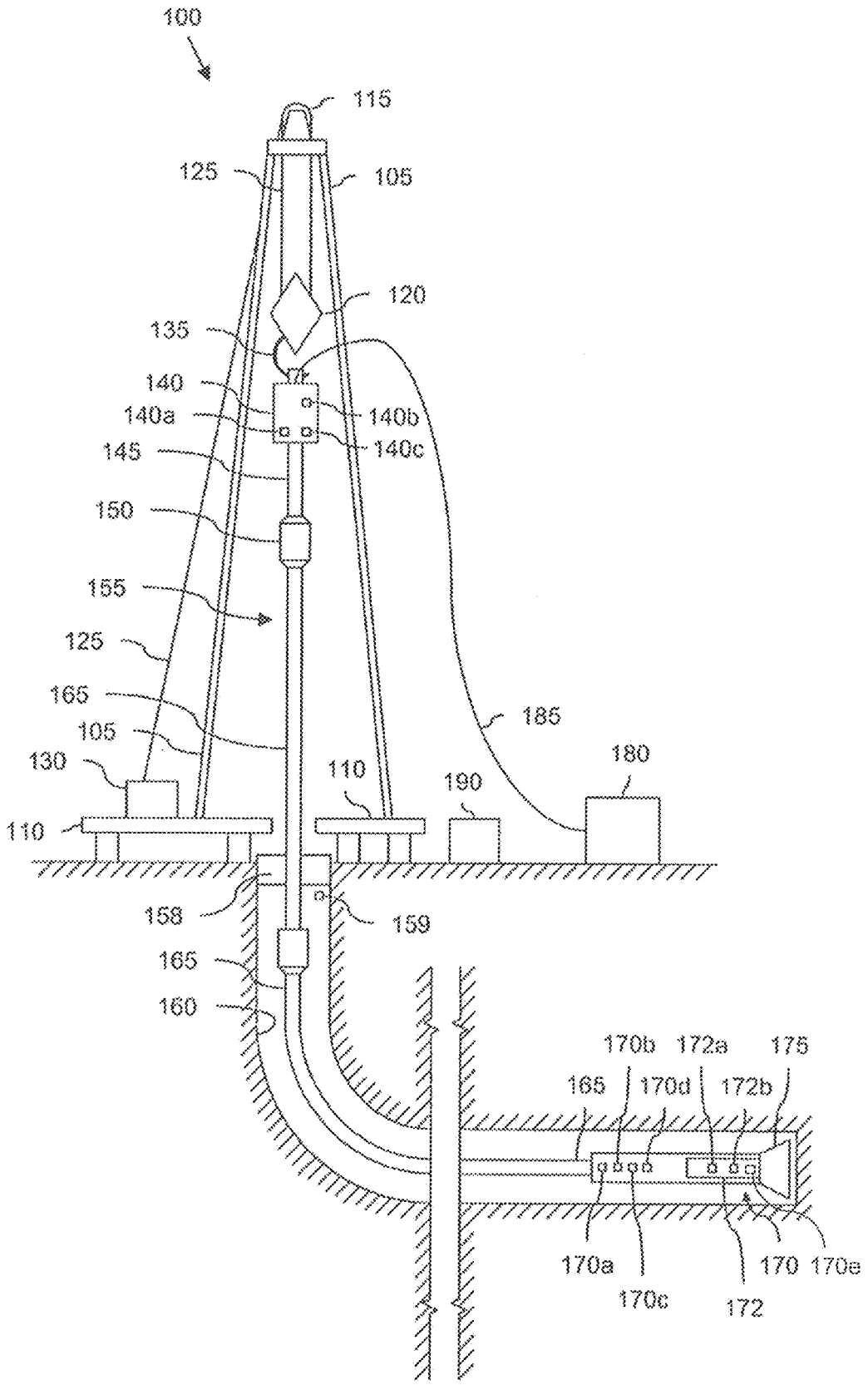
FIG. 1 is a schematic of an exemplary drilling apparatus according to one or more aspects of the present disclosure.

It is to be understood that the following disclosure provides many different implementations, or examples, for implementing different features of various implementations. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various implementations and/or configurations discussed.

The systems and methods disclosed herein provide intuitive visualizations of drilling windows which may be indicative of drilling tolerances along a drill plan. These visualizations may help provide a more intuitive view of a down hole environment and correspond to more intuitive control of BHAs during a drilling procedure, as well as intuitive performance measurements. These visualizations may be created from data received from external sources such as geological surveys as well as sensors associated with the drill systems and other input data.

Referring to FIG. 1, illustrated is a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel in and out the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly. The term "quill" as used herein is not limited to a component which directly extends from the top drive, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

The drill string 155 includes interconnected sections of drill pipe 165, a bottom hole assembly (BHA) 170, and a drill bit 175. The BHA 170 may include stabilizers, drill collars, and/or measurement-while-drilling (MWD) or wireline conveyed instruments, among other components. For the purpose of slide drilling the drill string may include a down hole motor with a bent housing or other bend component, operable to create an off-center departure of the hit from the center line of the wellbore. The direction of this departure in a plane normal to the wellbore is referred to as the toolface angle or toolface. The drill bit 175, which may also be referred to herein as a "tool," or a "toolface," may be connected to the bottom of the BHA 170 or otherwise attached to the drill string 155. One or more pumps 180 may deliver drilling fluid to the drill string 155 through a hose or other conduit, which may be connected to the top drive 140.

The down hole MWD or wireline conveyed instruments may be configured for the evaluation of physical properties such as pressure, temperature, gamma radiation count, torque, weight-on-bit (WOB), vibration, inclination, azimuth, toolface orientation in three-dimensional space, and/or other down hole parameters. These measurements may be made down hole, stored in memory, such as solid-state memory, for some period of time, and downloaded from the instrument(s) when at the surface and/or transmitted in real-time to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, transmission as electromagnetic pulses, among other methods. The MWD sensors or detectors and/or other portions of the BHA 170 may have the ability to store measurements for later retrieval via wireline and/or when the BHA 170 is tripped out of the wellbore 160.

In an exemplary implementation, the apparatus 100 may also include a rotating blow-out preventer (BOP) 158 that may assist when the well 160 is being drilled utilizing under-balanced or managed-pressure drilling methods. The apparatus 100 may also include a surface casing annular pressure sensor 159 configured to detect the pressure in an annulus defined between, for example, the wellbore 160 (or casing therein) and the drill string 155.

In the exemplary implementation depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a down hole motor, and/or a conventional rotary rig, among others.

The apparatus 100 also includes a controller 190 configured to control or assist in the control of one or more components of the apparatus 100. For example, the controller 190 may be configured to transmit operational control signals to the drawworks 130, the top drive 140, the BHA 170 and/or the pump 180. The controller 190 may be a stand-alone component installed on the rig floor 110 near the mast 105 and/or near other components of the apparatus 100. In an exemplary implementation, the controller 190 includes one or more systems located in a control room in communication with the apparatus 100, such as the general purpose shelter often referred to as the "doghouse" serving as a combination tool shed, office, communications center, and general meeting place. The controller 190 may be configured to transmit the operational control signals to the drawworks 130, the top drive 140, the BHA 170, and/or the pump 180 via wired or wireless transmission devices which, for the sake of clarity, are not depicted in FIG. 1.

The controller 190 is also configured to receive electronic signals via wired or wireless transmission devices (also not shown in FIG. 1) from a variety of sensors included in the apparatus 100, where each sensor is configured to detect an operational characteristic or parameter. Depending on the implementation, the apparatus 100 may include a down hole annular pressure sensor **170*a* coupled to or otherwise associated with the BHA 170. The down hole annular pressure sensor 170*a* may be configured to detect a pressure value or range in an annulus shaped region defined between the external surface of the BHA 170 and the internal diameter of the wellbore 160, which may also be referred to as the casing pressure, down hole casing pressure, MWD casing pressure, or down hole annular pressure. Measurements from the down hole annular pressure sensor 170*a*** may include both static annular pressure (pumps off) and active annular pressure (pumps on).

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

The apparatus 100 may additionally or alternatively include a shock/vibration sensor **170*b* that is configured to detect shock and/or vibration in the BHA 170. The apparatus 100 may additionally or alternatively include a mud motor pressure sensor 172*a* that may be configured to detect a pressure differential value or range across one or more motors 172 of the BHA 170. The one or more motors 172 may each be or include a positive displacement drilling motor that uses hydraulic power of the drilling fluid to drive the drill bit 175, also known as a mud motor. One or more torque sensors 172*b* may also be included in the BHA 170 for sending data to the controller 190 that is indicative of the torque applied to the drill bit 175 by the one or more motors 172**.

The apparatus 100 may additionally or alternatively include a toolface sensor **170*c* configured to detect the current toolface orientation. The toolface sensor 170*c* may be or include a conventional or future-developed magnetic toolface sensor which detects toolface orientation relative to magnetic north. Alternatively, or additionally, the toolface sensor 170*c* may be or include a conventional or future-developed gravity toolface sensor which detects toolface orientation relative to the Earth's gravitational field. The toolface sensor 170*c* may also, or alternatively, be or include a conventional or future-developed gyro sensor. The apparatus 100 may additionally or alternatively include a weight on bit (WOB) sensor 170*d* integral to the BHA 170 and configured to detect WOB at or near the BHA 170**.

The apparatus 100 may additionally or alternatively include a gamma sensor **170*e* configured to measure naturally occurring gamma radiation to characterize nearby rock and sediment. The gamma sensor 170*e* may be disposed in or associated with the BHA 170**.

The apparatus 100 may additionally or alternatively include a torque sensor **140*a* coupled to or otherwise associated with the top drive 140. The torque sensor 140*a* may alternatively be located in or associated with the BRA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotational speed of the quill 145**.

The top drive 140, drawworks 130, crown or traveling block, drilling line or dead line anchor may additionally or alternatively include or otherwise be associated with a WOB sensor **140*e* (WOB calculated from a hook load sensor that can be based on active and static hook load) (e.g., one or more sensors installed somewhere in the load path mechanisms to detect and calculate WOB, which can vary from rig to rig) different from the WOB sensor 170***d*. The WOB sensor 140*c* may be configured to detect a WOB value or range, where such detection may be performed at the top drive 140, drawworks 130, or other component of the apparatus 100.

The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection devices may include one or more interfaces which may be local at the well/rig site or located at another, remote location with a network link to the system.

Figure 2:
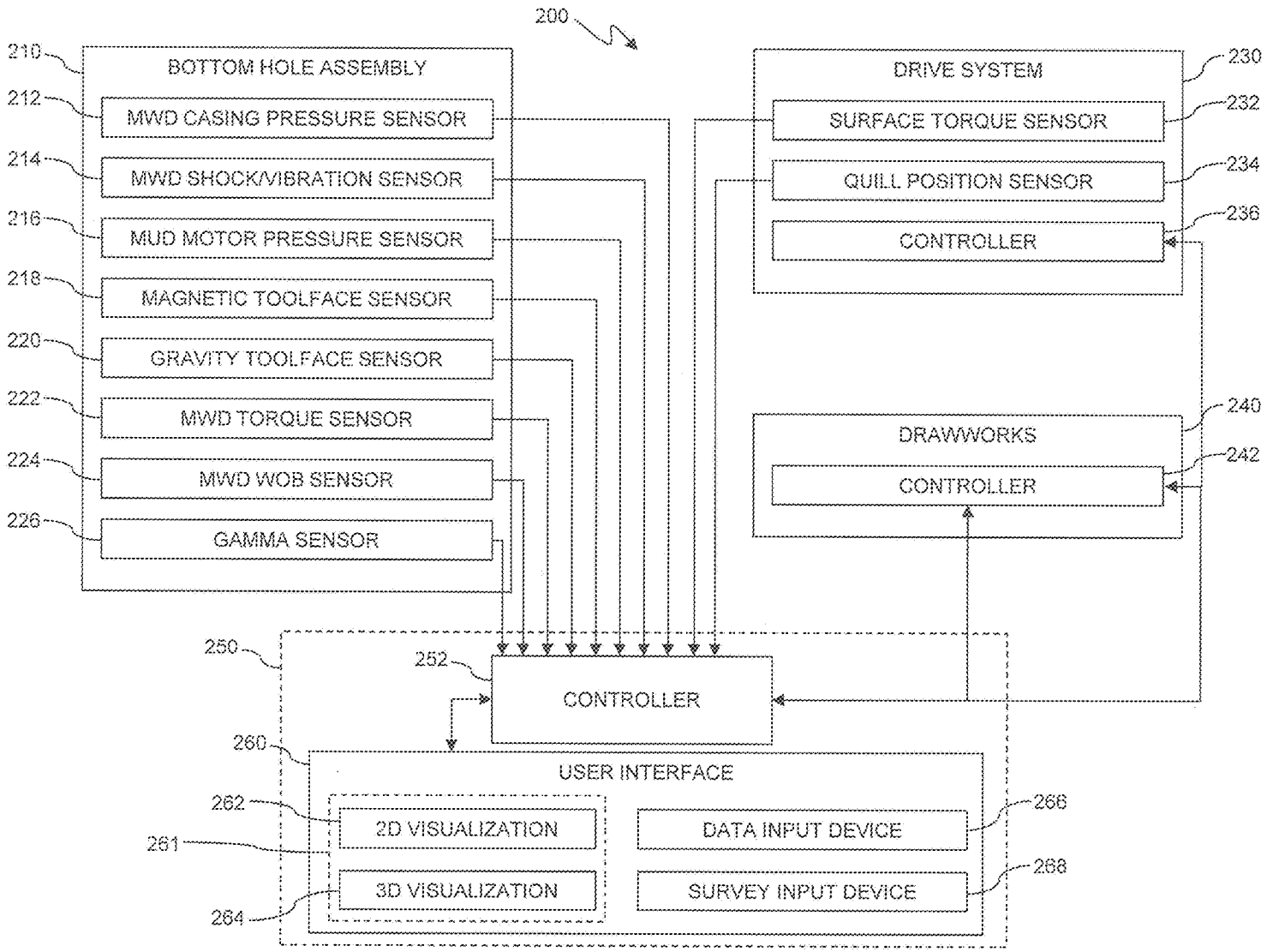
FIG. 2 is a schematic of an exemplary sensor and control system according to one or more aspects of the present disclosure.

Referring to FIG. 2, illustrated is a block diagram of an apparatus 200 according to one or more aspects of the present disclosure. The apparatus 200 includes a user interface 260, a bottom hole assembly (BHA) 210, a drive system 230, a drawworks 240, and a controller 252. The apparatus 200 may be implemented within the environment and/or apparatus shown in FIG. 1. For example, the BHA 210 may be substantially similar to the BHA 170 shown in FIG. 1, the drive system 230 may be substantially similar to the top drive 140 shown in FIG. 1, the drawworks 240 may be substantially similar to the drawworks 130 shown in FIG. 1, and the controller 252 may be substantially similar to the controller 190 shown in FIG. 1.

The user interface 260 and the controller 252 may be discrete components that are interconnected via wired or wireless devices. Alternatively, the user interface 260 and the controller 252 may be integral components of a single system or controller 250, as indicated by the dashed lines in FIG. 2.

The user interface 260 may include data input device 266 for user input of one or more toolface set points, and may also include devices or methods for data input of other set points, limits, and other input data. The data input device 266 may include a keypad, voice-recognition apparatus, dial, button, switch, slide selector, toggle, joystick, mouse, data base and/or other conventional or future-developed data input device. Such data input device 266 may support data input from local and/or remote locations. Alternatively, or additionally, the data input device 266 may include devices for user-selection of predetermined toolface set point values or ranges, such as via one or more drop-down menus. The toolface set point data may also or alternatively be selected by the controller 252 via the execution of one or more database look-up procedures. In general, the data input device 266 and/or other components within the scope of the present disclosure support operation and/or monitoring from stations on the rig site as well as one or more remote locations with a communications link to the system, network, local area network (LAN), wide area network (WAN), Internet, satellite-link, and/or radio, among other devices.

The user interface 260 may also include a survey input device 268. The survey input device 268 may include information gathered from sensors regarding the orientation and location of the BHA 210. In some implementations, information is automatically entered into the survey input device 268 and the user interface at regular intervals.

The user interface 260 may also include a display device 261 arranged to present a two-dimensional visualization 262 and a three-dimensional visualization 264 for visually presenting information to the user in textual, graphic, or video form. In some implementations, the display device 261 is a computer monitor, an LCD or LED display, table, touch screen, or other display device. In some implementations, the two-dimensional visualization 262 and the three-dimensional visualization 264 include one or more depictions. As used herein, a "depiction" is a two-dimensional or three-dimensional user-viewable representation of an object (such as a BHA) or other data (such as a drill plan). These depictions may be figurative, and may be accompanied by data in a textual format. As used herein, a "visualization" is a two-dimensional or three-dimensional user-viewable representation of one or more depictions. In some implementations, a visualization may include a control interface where users may enter data or instructions. For example, the two-dimensional visualization 262 may be utilized by the user to view sensor data and input the toolface set point data with the data input device 266. The toolface set point data input device 266 may be integral to or otherwise communicably coupled with the two-dimensional visualization 262. The two-dimensional visualization 262 may also be used to visualize a particular drilling window as compared with the location of the BHA or drilled wellbore. In other implementations, a visualization is a representation of an environment from the viewpoint of a simulated camera. This viewpoint may be zoomed in or out, moved, or rotated to view different aspects of one or more depictions. For example, the three-dimensional visualization 264 may show a down hole environment including depictions of the BHA, the drill plan, and one or more drilling windows. Furthermore, the down hole environment may include information from a control interface overlaid on depictions of the BHA and drill plan. The three-dimensional visualization 264 may incorporate information shown on the two-dimensional visualization 262. In some cases, the three-dimensional visualization 264 includes a two-dimensional visualization 262 overlaid on a three-dimensional visualization of the down hole environment which may include a depiction of a drill plan. The two-dimensional visualization 262 and three-dimensional visualization 264 will be discussed in further detail with reference to FIG. 3.

Still with reference to FIG. 2, the BHA 210 may include an MWD casing pressure sensor 212 that is configured to detect an annular pressure value or range at or near the MWD portion of the BHA 210, and that may be substantially similar to the down hole annular pressure sensor 170*a* shown in FIG. 1. The casing pressure data detected via the MWD casing pressure sensor 212 may be sent via electronic signal to the controller 252 via wired or wireless transmission.

The BHA 210 may also include an MWD shock/vibration sensor 214 that is configured to detect shock and/or vibration in the MWD portion of the BHA 210, and that may be substantially similar to the shock/vibration sensor 170*b* shown in FIG. 1. The shock/vibration data detected via the MWD shock/vibration sensor 214 may be sent via electronic signal to the controller 252 via wired or wireless transmission.

The BHA 210 may also include a mud motor pressure sensor 216 that is configured to detect a pressure differential value or range across the mud motor of the BHA 210, and that may be substantially similar to the mud motor pressure sensor 172*a* shown in FIG. 1. The pressure differential data detected via the mud motor pressure sensor 216 may be sent via electronic signal to the controller 252 via wired or wireless transmission. The mud motor pressure may be alternatively or additionally calculated, detected, or otherwise determined at the surface, such as by calculating the difference between the surface standpipe pressure just off-bottom and pressure once the bit touches bottom and starts drilling and experiencing torque.

The BHA 210 may also include a magnetic toolface sensor 218 and a gravity toolface sensor 220 that are cooperatively configured to detect the current toolface, and that collectively may be substantially similar to the toolface sensor 170*c* shown in FIG. 1. The magnetic toolface sensor 218 may be or include a conventional or future-developed magnetic toolface sensor which detects toolface orientation relative to magnetic north. The gravity toolface sensor 220 may be or include a conventional or future-developed gravity toolface sensor which detects toolface orientation relative to the Earth's gravitational field. In an exemplary implementation, the magnetic toolface sensor 218 may detect the current toolface when the end of the wellbore is less than about 7° from vertical, and the gravity toolface sensor 220 may detect the current toolface when the end of the wellbore is greater than about 7° from vertical. However, other toolface sensors may also be utilized within the scope of the present disclosure, including non-magnetic toolface sensors and non-gravitational inclination sensors. In any case, the toolface orientation detected via the one or more toolface sensors (e.g., magnetic toolface sensor 218 and/or gravity toolface sensor 220) may be sent via electronic signal to the controller 252 via wired or wireless transmission.

The BHA 210 may also include a MWD torque sensor 222 that is configured to detect a value or range of values for torque applied to the bit by the motor(s) of the BHA 210, and that may be substantially similar to the torque sensor 172*b* shown in FIG. 1. The torque data detected via the MWD torque sensor 222 may be sent via electronic signal to the controller 252 via wired or wireless transmission.

The BHA 210 may also include a MWD WOB sensor 224 that is configured to detect a value or range of values for WOB at or near the BHA 210, and that may be substantially similar to the WOB sensor 170*d* shown in FIG. 1. The WOB data detected via the MWD WOB sensor 224 may be sent via electronic signal to the controller 252 via wired or wireless transmission.

The BHA 210 may also include a lithology sensor. The lithology sensor may be any type of sensor to determine the location and/or composition of geologic formations around a drilling operation. In some implementations, the lithology sensor is a gamma sensor 226 that is configured to assist an operator in gathering lithology data from the formations around the BHA. In some implementations, the gamma sensor 226 is configured to measure naturally occurring gamma radiation to characterize nearby rock and sediment, and may be substantially similar to the gamma sensor 170*e* shown in FIG. 1. In some implementations, the gamma sensor 226 produces a simple gamma count of gamma rays incident on the gamma sensor 226. In other implementations, the gamma sensor 226 is configured to measure a direction associated with a gamma count. This type of gamma sensor 226 may be referred to as an azimuthal gamma sensor and may be particularly useful in gathering lithology information for directional drilling applications. In some implementations, an azimuthal gamma sensor may produce a list of gamma counts taken at different times and positions, wherein each gamma count corresponds to an angular measurement of the gamma sensor.

The drawworks 240 may include a controller 242 and/or other devices for controlling feed-out and/or feed-in of a drilling line (such as the drilling line 125 shown in FIG. 1). Such control may include rotational control of the drawworks (in v. out) to control the height or position of the hook, and may also include control of the rate the hook ascends or descends.

The drive system 230 may include a surface torque sensor 232 that is configured to detect a value or range of the reactive torsion of the quill or drill string, much the same as the torque sensor 140*a* shown in FIG. 1. The drive system 230 also includes a quill position sensor 234 that is configured to detect a value or range of the rotational position of the quill, such as relative to true north or another stationary reference. The surface torsion and quill position data detected via the surface torque sensor 232 and the quill position sensor 234, respectively, may be sent via electronic signal to the controller 252 via wired or wireless transmission. The drive system 230 also includes a controller 236 and/or other devices for controlling the rotational position, speed, and direction of the quill or other drill string component coupled to the drive system 230 (such as the quill 145 shown in FIG. 1).

The controller 252 may be configured to receive one or more of the above-described parameters from the user interface 260, the BHA 210, the drawworks 240, and/or the drive system 230, and utilize such parameters to continuously, periodically, or otherwise determine the current toolface orientation. The controller 252 may be further configured to generate a control signal, such as via intelligent adaptive control, and provide the control signal to the drive system 230 and/or the drawworks 240 to adjust and/or maintain the toolface orientation. For example, the controller 252 may provide one or more signals to the drive system 230 and/or the drawworks 240 to increase or decrease WOB and/or quill position, such as may be required to accurately "steer" the drilling operation.

Figure 3:
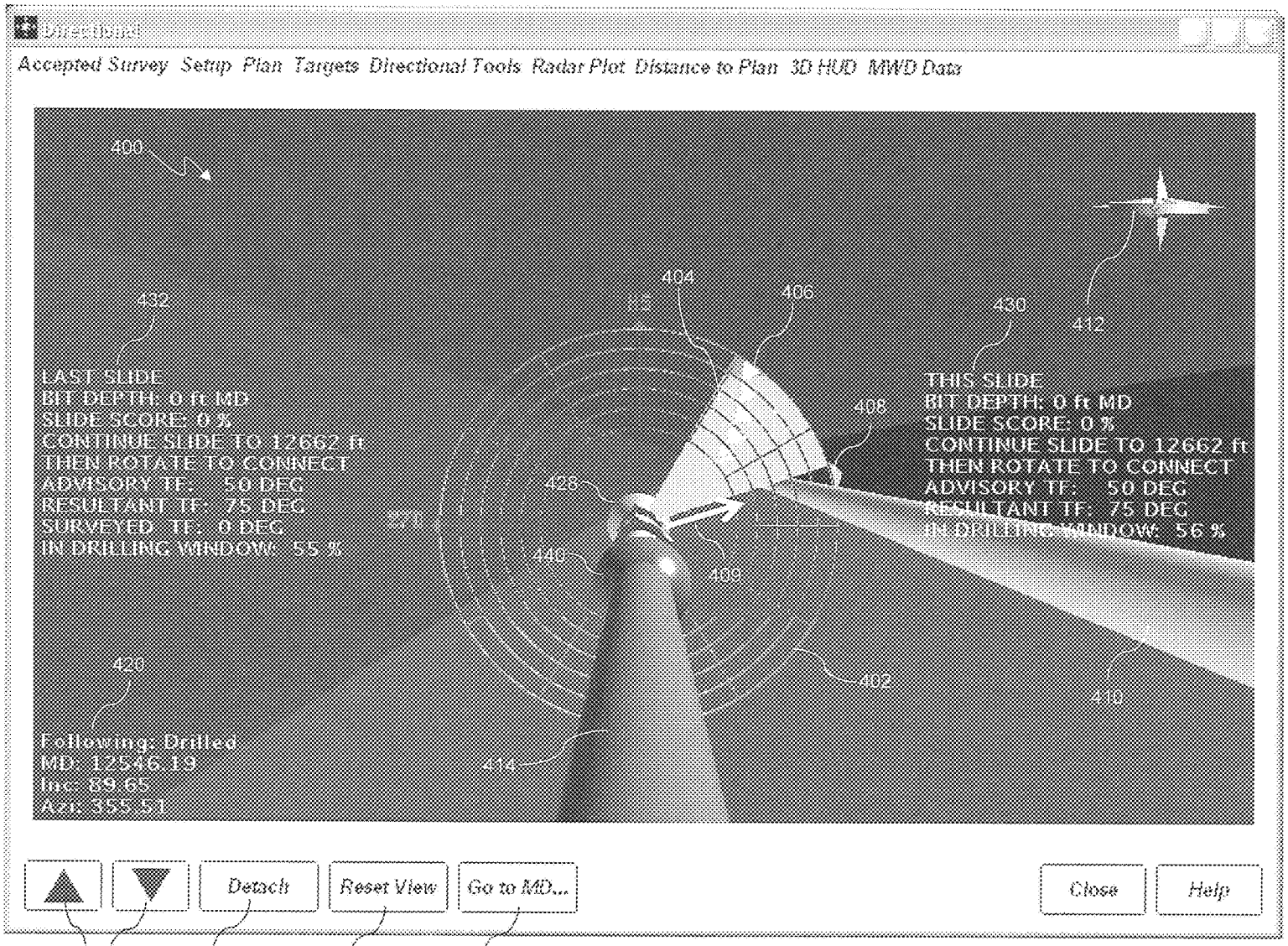
FIG. 3 is a representation of an exemplary display apparatus showing a three-dimensional visualization according to one or more aspects of the present disclosure.

FIG. 3 is an exemplary representation of an HMI 400 configured to relay information about the toolface location and orientation to a user of the display device 261 of FIG. 2. This display may be the three-dimensional visualization 264 of FIG. 2. In the example of FIG. 3, the HMI 400 includes three-dimensional depictions of a drill plan 410, a drilling motor and BHA 428, and a drilled wellbore 414, as well as two-dimensional depictions. The HMI 400 may be used by an operator to gain an intuitive view of the BHA and drill plan. In some implementations, the HMI 400 shows a "camera view" of the down hole environment, or the view that a simulated camera would show if imaging aspects of the down hole environment. In particular, the depiction of the drill plan 410 may appear as a long, cylindrical string extending through the down hole environment. The depiction of the drill plan 410 may be created in the three-dimensional display based on data of a desired drill plan entered or otherwise uploaded by the user. The depiction of the toolface angle at the BHA 428 appears as symbols 406 on the concentric circular grid 402 in the example of FIG. 3. This depiction shows the last recorded or measured location of the toolface and may include information about its orientation. In one implementation, data concerning the location and orientation of the BHA 428 are shown in index 420. In the example of FIG. 3, the index 420 indicates that the most recent depth of the drilling bit 428 was measured at 12546.19 feet, the inclination was 89.65°, and the azimuth was 355.51°. In some instances, the depiction of the BHA 428 is centered in the HMI 400, as shown in FIG. 3. In other implementations, index 420 contains data about the location and orientation of the simulated camera whose view is depicted in HMI 400.

A three-dimensional compass 412 shows the orientation of the present view of the HMI 400, and is an indication of an x-y-z coordinate system. The depiction of the drilled wellbore 414 extends outward from the depiction of the BHA 428. In some cases, the drilled wellbore 414 can depict the location of the drill string along with previous measurements of the location and orientation of the toolface.

One or more stations 440 may be depicted along the drilled wellbore 414 or drill plan 410. These stations 440 may represent planned or actual locations for events during a drilling operation. For example, the stations 440 may show the location of previous surveys taken during the drilling process. In some cases, these surveys are taken at regular intervals along the wellbore. Furthermore, real-time measurements are made ahead of the last standard survey, and can give the user feedback on the progress and effectiveness of a slide or rotation procedure. These measurements may be used to update aspects of the visualization such as the drilled wellbore 414 and concentric circular grid 402, advisory segment 404, symbols 406, and indicator 408. In other implementations, the stations 440 represent a position selected by a user. The stations 440 may represent sections of the drill plan 410 or drilled wellbore 414 corresponding to one or more drilling windows.

In the example of FIG. 3, the concentric circular grid 402, advisory segment 404, symbols 406, and indicator 408 are overlaid on the three-dimensional visualization. In the example of FIG. 3, the concentric circular grid 402, advisory segment 404, symbols 406, and indicator 408 are centered on the depiction of the BHA 428. In some implementations, indicator 408 may be alternatively depicted as a vector arrow 409. In either case, the indicator 408 and/or vector arrow 409 may indicate a recommended steering path.

Still referring to FIG. 3, index 430 shows data from the most recent movement of the drilling bit and toolface. Index 430 may include a current drilling bit depth measurement, a slide score, suggested corrective actions to align the BHA with the drill plan, and advisory measurements. In some implementations, the 400 may be used to provide feedback to a user in steering accuracy. The effectiveness of steering the actual toolface may be judged by a slide score.

Index 432 shows data from past movements of the toolface. In the example of FIG. 3, index 432 includes data from the last most recent section of the toolface steering, or sliding. Index 432 may contain similar data to that of 430. In some cases, indexes 430 and 432 allow the user to track the movement of the drilling motor as it is steered through the down hole environment.

HMI 400 also includes functions to adjust the three-dimensional view of the HMI 400. In particular, functions 422, 424, 426, and 434 allow a user to reorient the HMI 400 to view different aspects of the toolface or drill plan. In the example of FIG. 3, the view of the HMI 400 is centered on the drilled wellbore 414 with the depiction of the BHA 428 at the center. Function 422 removes the view of the HMI 400 from the drilled wellbore 414, which may be represented as "detaching" the simulated camera from the drilled wellbore 414 (or alternatively, the drill string). Function 424 resets the view of the HMI 400 to the view depicted in FIG. 3 with the display centered on the drilled wellbore 414. Function 426 reorients the view of HMI 400 to the bottom of the drilled wellbore 414 with the depiction of the BHA 428 in the center. Function 434, which includes arrow symbols, may be used to reorient the view of the HMI 400 to different positions along the drilled wellbore 414. In some implementations, function 434 allows a user to travel up and down a depiction of the previous locations of the toolface and/or a depiction of the drill string. The drilled wellbore 414 may extend back from a depiction of a BHA 428 and may include a number of stations 440 (shown as spheres) showing survey locations.

Figure 4:
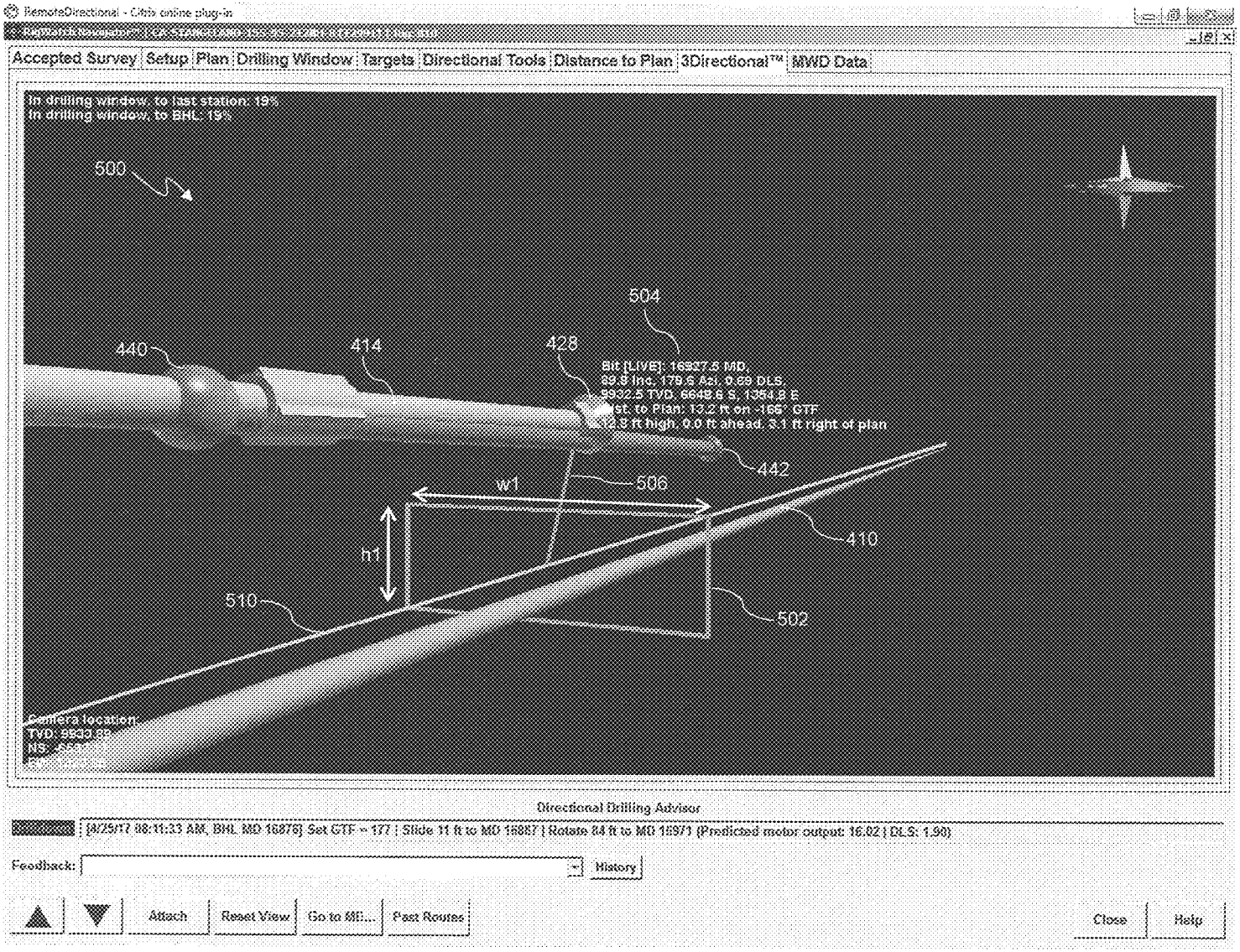
FIG. 4 is a representation of an exemplary display apparatus showing a three-dimensional visualization with a drilling window according to one or more aspects of the present disclosure.

FIG. 4 shows a three-dimensional HMI 500 including a drilling window 502. In some implementations, the HMI 500 may include one or more aspects of the HMI 400 shown in FIG. 3. For example, the HMI 500 may include three-dimensional depictions of a drill plan 410, a modified drill plan 510, and a drilled wellbore 414. The HMI 500 may also include an index 504 showing data related to the position of the BHA showing the position of the BHA 428, or in the example of FIG. 5, the position of the simulated camera.

Figure 5:
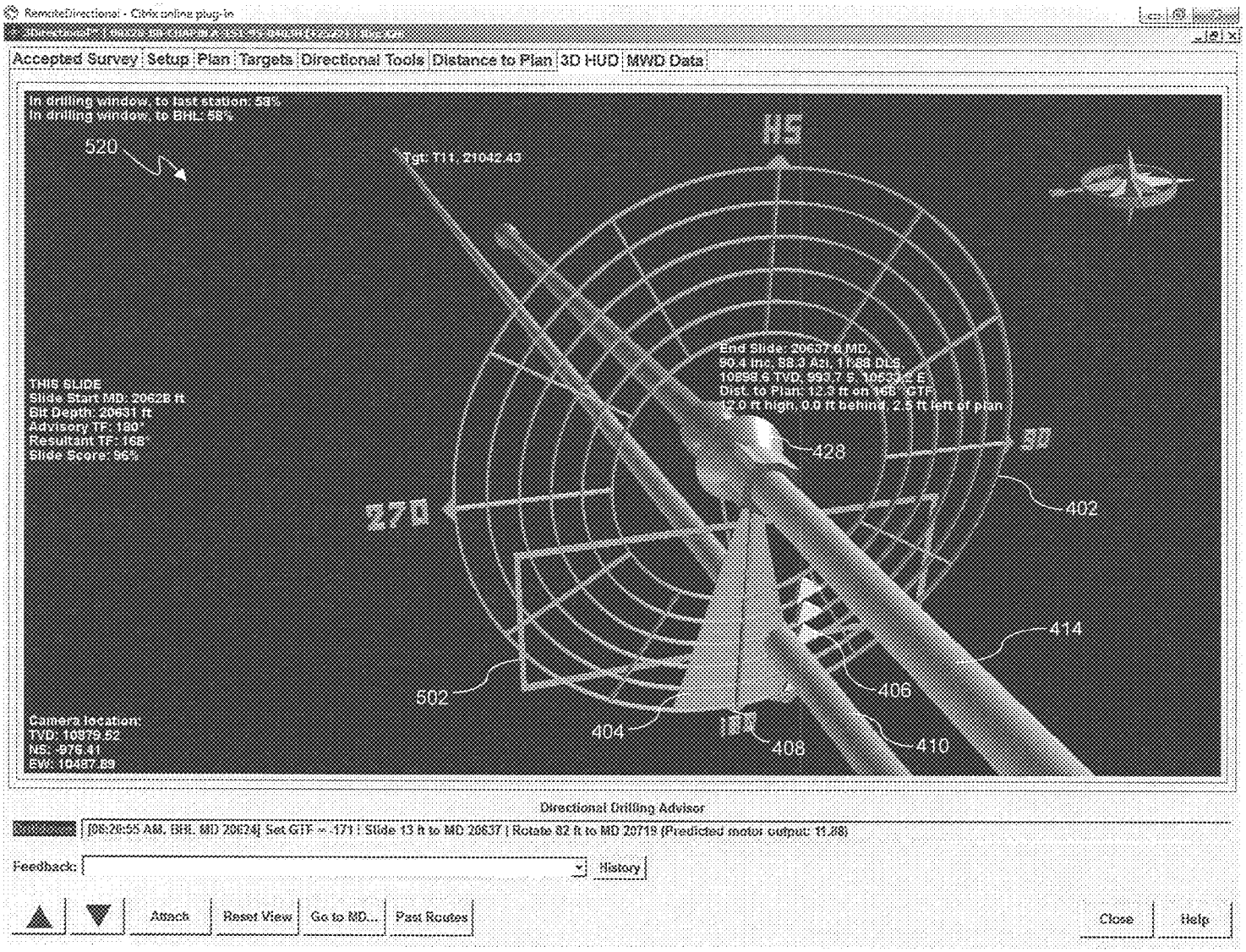
FIG. 5 is a representation of an exemplary display apparatus showing another three-dimensional visualization with a drilling window according to one or more aspects of the present disclosure.
Figure 6:
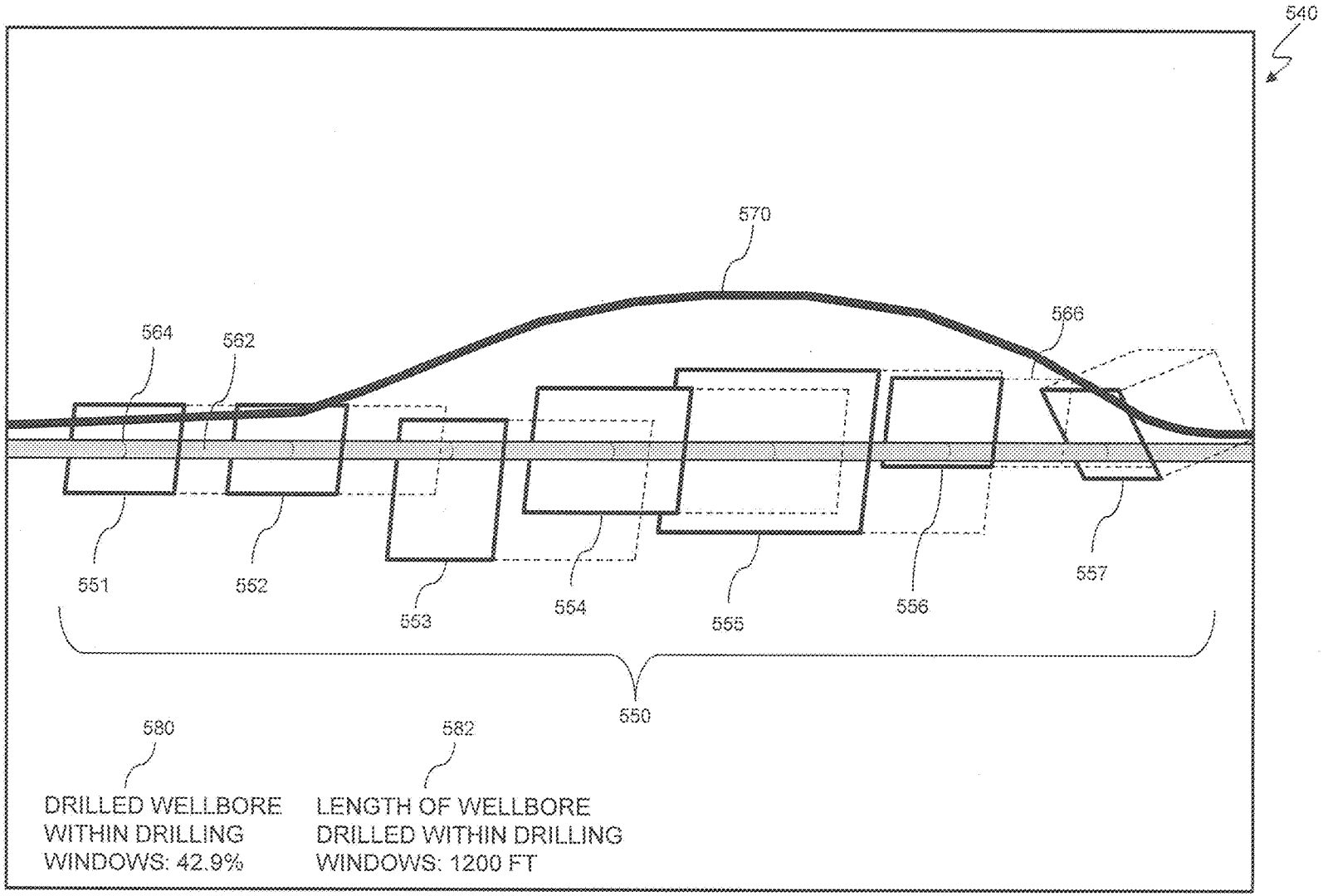
FIG. 6 is a graphical representation of a series of drilling windows according to one or more aspects of the present disclosure.

In some implementations, a drilling window 502 is placed around a portion of the drill plan 410 or modified drill plan 510. In some implementations, a modified drill plan 510 is established during the drilling operation representing a change in response to updated data related to geology or equipment. For example, the modified drill plan 510 is shifted slightly to the left of the drill plan 410. Although a single drilling window 502 is shown in FIG. 4, in some implementations, a series of drilling windows 502 are placed along the drill plan 410. In the example of FIG. 5, the drilling window 502 is disposed around a generally horizontal portion of the drill plan 410. The drilling window 502 may be placed in a plane perpendicular to the longitudinally extending drill plan 410. In the example of FIG. 5, the drilling window 502 has a rectangular shape with width w1 and height h1. The drilling window 502 may be connected with other drilling windows (as shown in FIG. 6) such that the drilling windows form extruded rectangular prisms along the drill plan 410. In other implementations, the drilling window 502 may have other shapes such as, for example, square, polygon, circle, ellipse, overall and/or irregular shapes.

The drilling windows 502 may be generated with boundaries that define acceptable deviation from a drill plan or a modified drill plan. As such, the drilling windows 502 may correspond with the drilling tolerance at a particular place on the drill plan 410. For example, the width w1 may correspond with a tolerance in the x-direction (with respect to the drill plan 410) and the height h1 may correspond with tolerance in the y-direction. Some factors that may dictate the size or shape of the drilling window 502 may include proximity to other wellbores, whether planned or already drilled, geological formations including formations targeted and formations to be avoided, geological layers generally, the size of any deposits, and other factors. In the example of FIG. 4, w1 is about 60 feet and h1 is about 30 feet. In this case, the drill plan is nearly horizontal, so the tolerance in the x-direction is a horizontal tolerance while the tolerance in the y-direction is a vertical tolerance. In the example of FIG. 4, the horizontal tolerance is greater than the vertical tolerance and so w1 is greater than h1. This may be the case because during the horizontal portions of some drill plans, vertical errors can be more costly than horizontal errors due to the position of geological layers and/or a desire to have multiple wellbores close together. In other locations along the drill plan, such as vertical or near-vertical sections, the drilling windows 502 may have tolerances in the x- and y-directions that are nearly equal. In other implementations, the dimensions of the one or more drilling windows 502 may have other shapes, such as curves, polygons, circles, ellipses, and irregular shapes. These shapes may be chosen to conform the drilling tolerances around a drill plan and may be changed throughout a drilling operation.

The orientation, position, and size of each drilling window 502 may be varied independently. In some implementations, the drilling windows 502 are centered on the drill plan 410, while in other implementations, one or more drilling windows 502 are offset from the drill plan 410. The drilling windows 502 may be placed at regular intervals along the drill plan 410, such as about every 10 feet or 3 meters. In other implementations, drilling windows 502 are placed at about every 1 foot, at about every 20 feet, or at about every 50 feet. Some implementations include drilling windows spaced apart by a distance equivalent to a drill string stand. In one example, a drill string stand has a length between about 90 and 110 feet. The intervals between drilling windows 502 may be varied. For example, in difficult sections of the drill plan 410, the drilling windows 502 may be placed closer together to help an operator more easily visualize the correct route. In the example of FIG. 4, the drilling window 502 is roughly perpendicular to the drill plan 410, but drilling windows may be placed at different angles relative to the drill plan 410, such that each drilling window 502 has a particular tilt or "dip angle" relative to the drill plan 410. In some implementations, drilling windows generated with dip angles may not include the original well plan along their entire length. For example, drilling window 557 (as shown in FIG. 6) is generated with a dip angle and does not include the original well plan 562 along its entire length. This may occur in certain environments where geological steering information informs directional drillers that the original drill plan does not coincide with an ideal drill plan and changes are required. The changes may be facilitated by the offsets and tilt angles of the drilling windows.

The three-dimensional HMI 500 of FIG. 4 also shows a depiction of the drilled wellbore 414. The depiction of the drilled wellbore 414 may include a depiction the BHA 428 in a location relative to the drill plan 410 and a projected position 442 of the BHA. In the example of FIG. 4, the location of the BHA 428 is compared to the modified drill plan 510 and the drilling window 502 by a controller in the drilling system (such as controller 252 as shown in FIG. 2). Information comparing these features is shown in index 504. In some implementations, normal plan clearance calculations are carried out by the controller to compare the location of the BHA 428 to a drill plan 410 or modified drill plan 510. These calculations may be based on points of interest along the drilled wellbore 414 as well as a corresponding point of interest on the drill plan 410 or modified drill plan 510. The controller 242 may render results of the normal plane clearance calculations in polar directions and distances, which may be converted to a rectangular offsets by an algorithm run by the controller 242. In the example of FIG. 6, the distance between the location of the BHA 428 and the modified drill plan 510 is shown by line 506. The index 504 states that the location of the bit at the distal end of the BHA 428 is 12.8 feet high and 3.1 feet right with respect to the modified drill plan 510.

The controller may also be configured to determine whether or not the drilled wellbore 414 (including the BHA at an end) is within the drilling window 502. In some implementations, the proximity of the BHA 428 to the drilling window 502 is calculated at every station 440 (FIG. 3; corresponding to the performance of a survey). Proximity calculations may also be carried out by the controller at interpolated points along the drilled wellbore 414 and/or at a projected location 442 of the BHA 428. In some implementations, the proximity calculations are carried out by the controller at every 10 feet or 3 meters. Other distances between calculations may be used, such as at every 1 foot, at every 20 feet, or at every 50 feet. Some implementations the calculations are carried out at increments spaced apart by a distance equivalent to a drill string stand. In one example, a drill string stand has a length between about 90 and 110 feet. These proximity calculations may be used to render a status in relation to the drilling window 502 (i.e., "in window" or "out of window"). In some implementations, the color of the drilling window 502 may represent the position of the drilled wellbore 414 in relation to the drilling window 502. For example, the drilling window 502 may be green if the drilled wellbore 414 passes through it and red if the drilled wellbore does not pass through it. Other colors are possible, as well as patterns, shapes or other graphical representations to show the status of the drilling window 502.

Figure 7:
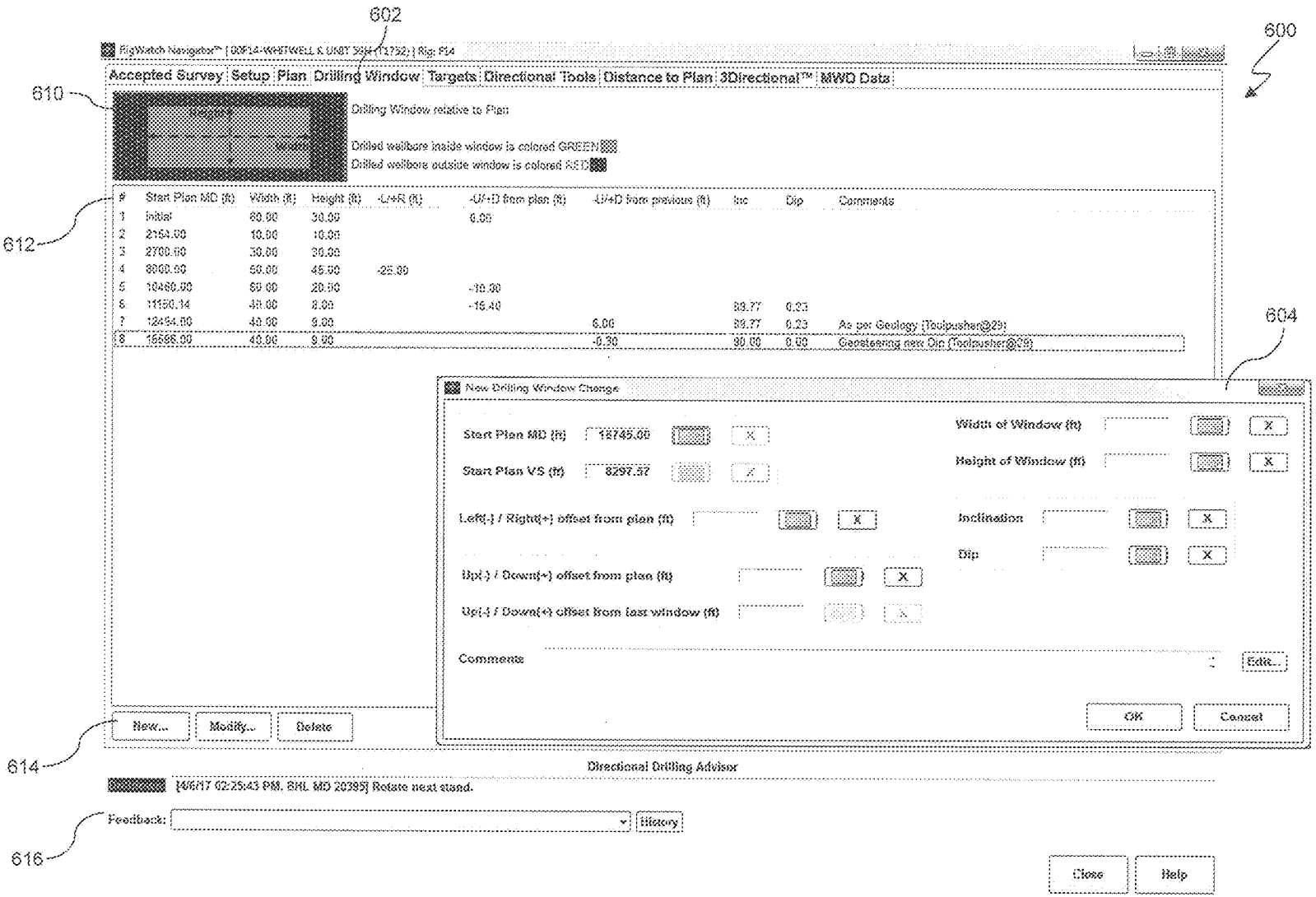
FIG. 7 is a representation of an exemplary control panel for generating and changing drilling windows according to one or more aspects of the present disclosure.

In some implementations, the controller 252 is configured to store the status of each drilling window with respect to the BHA and calculate a length of the drilled wellbore that was drilled within drilling windows 502. This length may be used as a Key Performance Indicator (KPI) for the drilling operation, as well as the percentage of the drilled wellbore that was drilled within the drilling windows 502 compared to the entire drilled wellbore. To arrive at this KPI, the controller may determine the distance (in feet or meters) along which the drilled wellbore 414 was within the drilling windows 502. This distance may be divided by the total depth of the wellbore (in feet or meters). This KPI may be displayed by a display device in the drilling system, such as on the HMI 500 or on control windows 600 as shown in FIG. 7. In some implementations, the results of the extent of the drilled wellbore 414 within and without all of the drilling windows 502 associated with the drill plan 410 may be viewed in a two-dimensional representation such as in x-y graph format.

FIG. 5 shows an exemplary representation of an HMI 520 that includes aspects of the HMI 400 shown in FIG. 3 and the drilling window 502 of HMI 500 shown in FIG. 4. In some implementations, the concentric circular grid 402, advisory segment 404, symbols 406, and indicator 408 are overlaid on the three-dimensional depictions of the drilled wellbore 414 and the drilling window 502. The indicator 408 may be positioned to show a driller an ideal route for placing the BHA 428 either in the center of the drilling window 502 or within another area of the drilling window 502 around the drill plan 410. In some implementations, the concentric circular grid 402, advisory segment 404, symbols, 406, and indicator 408 may be added or removed from the HMI 520 as desired by the operator by using the user interface 260 (FIG. 2). This functionality may allow an operator to view more specific data if required without distracting from other aspects of the visualizations.

FIG. 6 shows a graphical representation 540 of a series 550 of drilling windows including drilling windows 551, 552, 553, 554, 555, 556, and 557. Each drilling window of the series 550 may be similar to the drilling window 502 show in FIGS. 4 and 5. The graphical representation 540 also includes a depiction of a drilled wellbore 570, represented by a thick unbroken line. The drilling windows of the series 550 are shown relative to a drill plan 562, and each drilling window of the series 550 may correspond to an index location 564 on the drill plan 562. The index location 564 may represent a location where the BHA or a portion of the drilled wellbore 570 is compared to the respective drilling window of the series 550. In some implementations, each drilling window of the series 550 has the shape of an extruded rectangular prism. The face of each drilling window of the series 550 is shown with a dark unbroken line, and the three-dimensional extension of each drilling window is shown by the dotted lines 566 (for example, in reference to drilling window 556). In some implementations, the drilling windows are rectangular with orthogonal vertex angles. In the example of FIG. 6, each drilling window of the series 550 abuts another drilling window, such that the entire drill plan 562 is covered.

Each drilling window of the series 550 may have a particular shape, size, position, and orientation with respect to the drill plan 562. For example, drilling windows 551, 552, 554, 555, 556, and 557 have a rectangular shape with widths and heights that are approximately equal. Drilling windows 551, 552, 556, and 557 have approximately the same size. Drilling window 553 has a height that is larger than its width. Drilling windows 551, 552, 553, 554, 555, and 556 are positioned in planes approximately perpendicular to the drill plan 562, while drilling window 557 is positioned in a plane at an angle with respect to the drill plan 562. Drilling windows 551, 552, 554, and 555 are centered on the drilling window, while drilling window 553 is offset in a downward position with respect to the drill plan 562 and drilling windows 556 and 557 are offset in an upward position with respect to the drill plan 562.

The drilled wellbore 570 is compared to the series 550 of drilling windows along the length of the drill plan 562. In the example of FIG. 6, the drilled wellbore 570 passes through drilling windows 551, 552, and 557 and does not pass through drilling windows 553, 554, 555, and 556. In some implementations, the drilled wellbore 570 is shown in green indicating that the drilling was on course (inside the drilling window) or in red to indicate the drilled wellbore 570 was off course (outside the drilling window). Other colors also may be used.

Index 580 shows a drilling performance KPI represented by a percentage. The drilling performance KPI may be calculated from the distance of the drilled wellbore within the drilling windows 551, 552, 553, 554, 555, 556, 557 divided by the total length of the drilled wellbore 570, expressed as a percentage. In the example of FIG. 6, the drilling performance KPI is 42.9%. In some implementations, the drilling performance KPI is calculated for an entire drill plan, while in other implementations, the drilling performance KPI is calculated for one or more portions of the drill plan.

Index 582 shows an alternative drilling performance KPI that may also be displayed on the display device or otherwise calculated and stored by the controller. Index 582 shows a length of wellbore that was drilled within the drilling windows. Index 582 may show the total length of wellbore drilled within the drilling windows for the entire drilling operation, or portions thereof. Data relating to each drilling window may also be displayed, such as the distance and direction that the drilled wellbore 570 is offset from each drilling window.

FIG. 7 shows an exemplary control panel 600 that may be used to generate, visualize, and make changes to drilling windows. The drilling windows discussed in FIG. 7 may be any of the drilling windows 502, 551, 552, 553, 554, 555, 556, and 557 as discussed in reference to FIGS. 4 and 5. Control panel 600 may include main window 602 and change window 604. Main window 602 may include a diagram 610 of a drilling window, a list 612 of drilling windows, option icons 614, and a feedback icon 616. The diagram 610 of the drilling window may show a two-dimensional representation of a selected drilling window of the list 612 of drilling windows, including the dimensions of the drilling window. The locations of a drill plan, a modified drill plan, and/or a drilled wellbore may be shown in relation to the drilling window in the diagram 610. Colors representing the location of the drilled wellbore (for example a green area that is highlighted if the drilled wellbore passes through the drilling window and a red area that is highlighted if the drilled wellbore does not pass through the drilling window) may be shown in the diagram 610.

The list 612 of drilling windows may show parameters relating to each drilling window, such as its depth and position along the drill plan, the width and height of the drilling window, the offsets of the drilling window with respect to the drill plan and other drilling windows, and an inclination and tilt angle of each drilling window, as well as other parameters. Reasons for different dimensions, offsets, and tilt angles may be recorded on the list 612. For example, the seventh drilling window on list 612 has a width of 40 feet, a height of 9 feet, an offset of 6 feet from the sixth drilling window, an inclination of 89.77 degrees, and a dip angle (or tilt angle) of 0.23 degrees. The reasons for one or more of these changes are listed "as per geology," signaling that the changes were made to account for a geological issue around the drill plan. An operator may add new drilling windows to the list 612 by using the option icons 614. In this case, the new drilling windows may be displayed in the visualization such as EMI 400 and 500.

The parameters of each drilling window may be independently changed through the use of the change window 604. The change window 604 may allow an operator to change any of the parameters of the drilling window as discussed above. The change window 604 may also allow the operator to include comments related to changes. The operator may give feedback about the drilling window or other operations through the use of the feedback icon 616.

Figure 8:
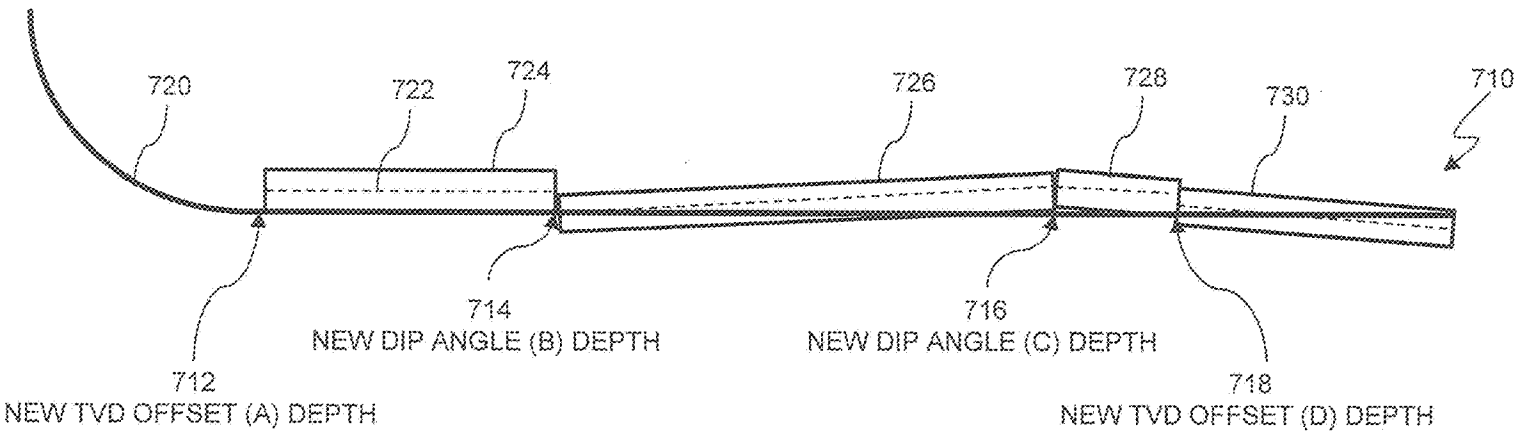
FIG. 8 is a representation of an exemplary control panel for modifying, generating, and visualizing drilling windows according to one or more aspects of the present disclosure.

FIG. 8 shows an exemplary control panel 700 that may be used to generate, visualize, and make changes to a drilling windows along a drill plan. The control panel 700 may be accompanied by a visualization 710 of an original drill plan 720 and several drilling windows 724, 726, 728, 730. The control panel 700 may show data corresponding to offsets and tilt angles of the drilling windows 724, 726, 728, 730. In the example of FIG. 8, the original drill plan 720 extends underground along a roughly horizontal path. The original drill plan 720 has been changed four times as shown at references 712, 714, 716, and 718. The offsets and tilt angles of the drilling windows 724, 726, 728, 730 may be used to show these changes and guide a directional driller along an adjusted ideal drilling path that varies from the original drill plan 720. At reference 712, the depth of the drill plan 720 is changed by adding a true vertical depth (TVD) offset of depth (A) to the drilling window 724. The dotted line representing the new adjusted ideal drilling path 722 is shown along with a drilling window 724 to indicate drilling tolerances around the adjusted ideal drilling path 722. At references 714 and 716, the adjusted ideal drilling path 722 is modified by changing the dip angle of the drilling windows 726, 728 (with angles (B) and (C)). At reference 718, the adjusted ideal drilling path 722 is modified by another TVD offset to drilling window 730 (with depth (D)). In some implementations, the control panel 700 may be used to keep track of the modifications that have been made to a drill plan 720 or adjusted ideal drilling path 722 for the operator's reference. In the example of FIG. 8, the control panel 700 shows the offset and dip angle of the last drilling window 730 in relation to the original drill plan 720.

Figure 9:
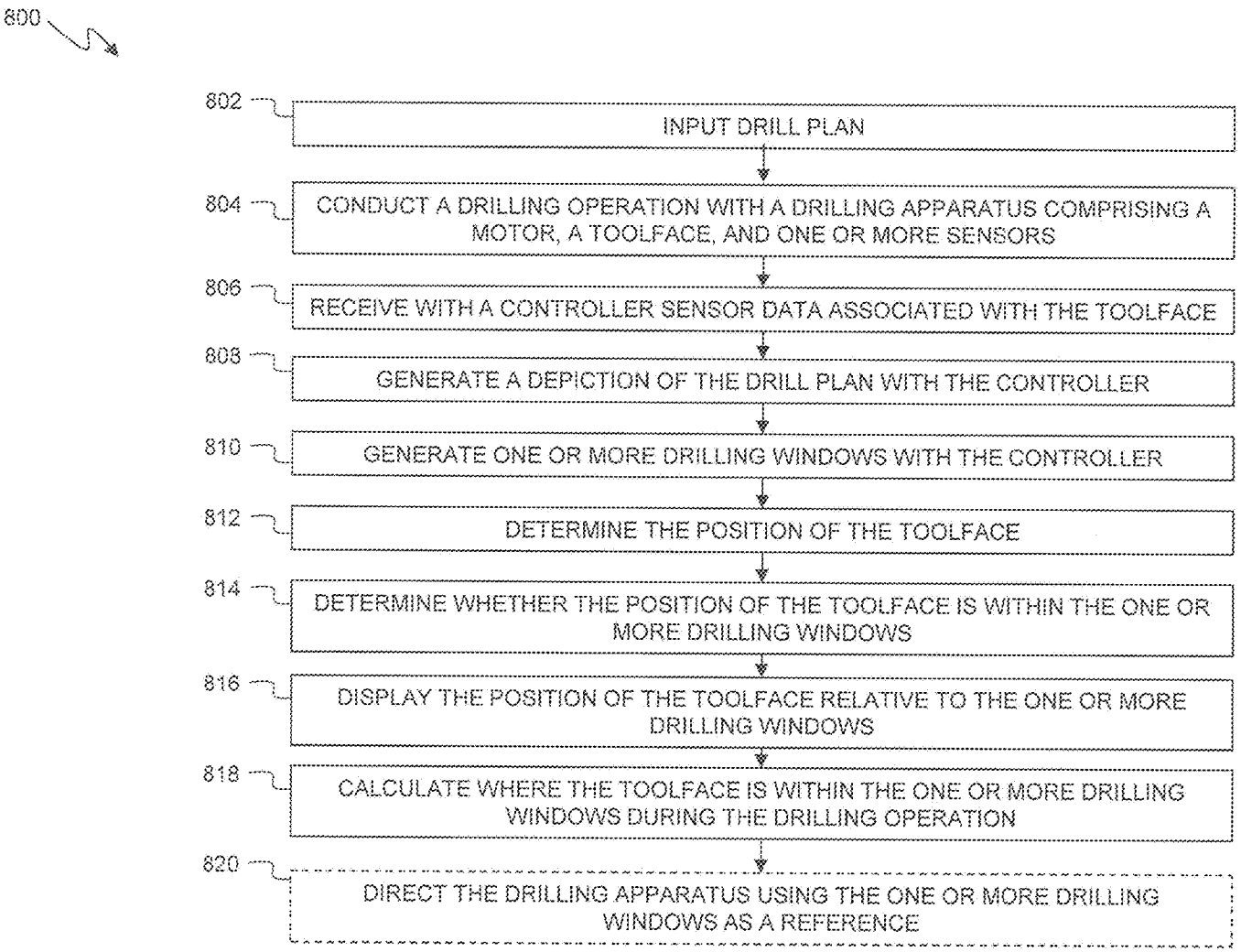
FIG. 9 is a flowchart diagram of a method of visualizing and steering a drill according to one or more aspects of the present disclosure.

FIG. 9 is a flow chart showing a method 800 of visualizing and steering a BHA in a down hole environment. It is understood that additional steps can be provided before, during, and after the steps of method 800, and that some of the steps described can be replaced or eliminated for other implementations of the method 800. In particular, any of the control systems disclosed herein, including those of FIGS. 1 and 2, and the displays of FIGS. 3-7, may be used to carry out the method 800.

At step 802, the method 800 may include inputting a drill plan. This may be accomplished by entering location and orientation coordinates into the controller 252 discussed with reference to FIG. 2. The drill plan may also be entered via the user interface, and/or downloaded or transferred to controller 252. The controller 252 may therefore receive the drill plan directly from the user interface or a network or disk transfer or using other systems or means.

At step 804, the method 800 may include conducting a drilling operation with a drilling apparatus comprising a steerable motor or a steerable BHA, and one or more sensors. The BHA may include a drilling bit. In some implementations, this drilling apparatus is apparatus 100 discussed in reference to FIG. 1. The drilling apparatus may be operated by an operator who inputs commands in a user interface that is connected to the drilling apparatus. The operation may include drilling a hole to advance the BI-IA through a subterranean formation.

At step 806, the method 800 may include receiving with a controller sensor data associated with the toolface angle. This sensor data can originate with sensors located near the bit in a down hole location, well as sensors located along the drill string or on the drill rig as described and shown with reference to FIGS. 1 and 2. In some implementations, a combination of controllers, such as those in FIG. 2, receive sensor data from a number of sensors via electronic communication. The controllers then transmit the data to a central location for processing.

At step 808, the method 800 may include generating a depiction of the drill plan with the controller, in some implementations, the depiction of the drill plan is similar to drill plan 410 as shown in FIGS. 3-5. The depiction of the drill plan may be shown in a three-dimensional visualization such as that shown in HMIs 400, 500, and 520 and may be displayed on any type of display device, such as a computer monitor. The drill plan may appear as a line passing through a three-dimensional environment (as shown in FIGS. 3-5) and may be used as a reference for the operator during the drilling operation.

At step 810, the method 800 may include generating one or more drilling windows with the controller. The one or more drilling windows may be similar to any of the drilling windows 502, 551, 552, 553, 554, 555, 556, or 557 as shown in FIGS. 3-6. In some implementations, a series of drilling windows is generated along the entire length of the drill plan. The one or more drilling windows may appear as two- or three-dimensional shapes in the visualization and may be placed relative to the drill plan. The parameters of the drilling windows may be individually varied as they are generated, as well as during the drilling operation as conditions change.

At step 812, the method 800 may include determining the position of the BHA and bit relative to the one or more drilling windows. The controller may make this determination after receiving sensor data received from the sensor system on the drilling apparatus related to the position of the BHA. The position of the BHA, bit, and survey sensor may also be determined by receiving and analyzing survey data collected throughout the drilling operation. The position of the bit may be displayed and may be accompanied with visualization tools such as targets, direction lines, and measurements, as well as data displayed in text format.

At step 814, the method 800 may include determining whether the position of the BHA and bit are within the one or more drilling windows. In some implementations, the controller makes this determination by comparing the parameters of the one or more drilling windows to the determined position of the BHA and bit as carried out in step 812. The determination of step 814 may be conducted at various points along the drill plan, and the controller may generate normal plane clearance calculations between the position of the toolface and drilling windows.

At step 816, the method 800 may include displaying the position of the BHA and bit relative to the one or more drilling windows. The depiction of the BHA may be similar to the depiction of the BHA 428 as shown in FIGS. 3-5. In some implementations, the depiction of the BHA includes a depiction of the drilled wellbore (such as the depiction of drilled wellbore 414 in FIGS. 3-5) or the route along which the BHA has traveled, with the depiction of the bit at the end. Step 816 may include displaying the results of the determination carried out in step 814. For example, a portion of the wellbore may be colored green if that portion of the wellbore is within the drilling window and red if the portion of the wellbore is not within the drilling window. The display may also include comparison data, such as measurements of the distance and polar directions between the drilling window, the BHA, and the bit. In some implementations, these measurements are converted to rectangular offsets, as discussed above.

At step 818, the method may include calculating where the BHA and bit is within the one or more drilling windows during the drilling operation. This calculation may involve analyzing (with the controller) the determination of step 814 for each drilling window. In particular, step 818 may include calculating a length along which the wellbore was within the drilling windows during the drilling operation. This length or the percentage discussed above may be displayed throughout the drilling operation to generate a measurement of performance.

At step 820, the method 800 may include directing the drilling apparatus using the one or more drilling windows as a reference. The one or more drilling windows may provide an easy to understand representation of the tolerances along the drill plan. The operator may use the depiction of the drilling windows as well as the ongoing comparison of BHA and bit position and the one or more drilling windows to see an intuitive view of the down hole environment and to make informed steering decisions.

In view of all of the above and the figures, one of ordinary skill in the art will readily recognize that the present disclosure introduces a method of directing the operation of a drilling system, that may include: generating, with a controller, one or more drilling windows around a portion of a drill plan, each of the one or more drilling windows having an outer boundary; drilling with a bottom hole assembly comprising a bit disposed at an end of a drill string to create a drilled bore; receiving sensor data from one or more sensors adjacent to or carried on the bottom hole assembly; determining, with the controller, a position of the bottom hole assembly based on the received sensor data; determining, with the controller, whether the determined position of the bottom hole assembly is within the outer boundary of the one or more drilling windows; and displaying, on a display device, the position of the bottom hole assembly relative to the one or more drilling windows.

The method may further include using the position of the bottom hole assembly relative to the one or more drilling windows as a reference to change the position of the bottom hole assembly. The method may also include generating, with the controller, a corrective action to move the bottom hole assembly into the one or more drilling windows if the controller determines that the bottom hole assembly is not within the outer boundary of the one or more drilling windows. The method may also include generating, with the controller, a corrective action to move the bottom hole assembly into the one or more drilling windows if the controller determines that the bottom hole assembly is not within the outer boundary of the one or more drilling windows.

In some implementations, determining a position of the bottom hole assembly comprises determining an orientation of a toolface, the method further comprising displaying the position of the bit relative to the one or more drilling windows on a three-dimensional display. The method may include generating the one or more drilling windows with a three-dimensional extruded rectangle shape. In some implementations, the one or more drilling windows are generated to represent a drilling tolerance at the portion of the drill plan around which the one or more drilling windows are generated. The method may include calculating, with the controller, a number of instances that the bottom hole assembly is within the outer boundary of the one or more drilling windows along the drill plan. The method may also include displaying, with the display device, a key performance indicator comprising a percentage of distance that the bottom hole assembly is within the outer boundary of the one or more drilling windows along the drill plan.

A drilling apparatus is also provided that may include: a drill string comprising a plurality of tubulars and a BHA operable to perform a drilling operation; a sensor system configured to detect one or more measureable parameters of a drilled wellbore; a controller in communication with the sensor system, wherein the controller is operable to generate a visualization comprising one or more drilling windows representing drilling tolerances of a drill plan of the drilling operation and a depiction of a location of the drill string based on the one or more measurable parameters of the drilled wellbore; and a display device in communication with the controller, the display device configured to display to an operator a visualization comprising the depiction of the location of the drill string and the one or more drilling windows.

In some implementations, the one or more measureable parameters of the drilled wellbore comprise an inclination measurement, an azimuth measurement, a toolface angle, and a hole depth. The controller may be further operable to generate a three-dimensional depiction of the drill plan, wherein the visualization further comprises the depiction of the drill plan. The one or more drilling windows may have a three-dimensional extruded rectangle shape. The controller may be operable to calculate a number of instances that the drill string is within the one or more drilling windows throughout the drilling operation. The controller may be operable to calculate a key performance indicator (KPI) based on a length of the drilled wellbore within the one or more drilling windows compared to a total length of the drilled wellbore.

An apparatus or steering a bottom hole assembly (BHA) is also provided, including: a controller configured to receive data representing a drill plan of a drilling operation and measured parameters indicative of positional information of the BHA in a down hole environment, wherein the controller is operable to generate a three-dimensional depiction of a most recent BHA position based on the measured parameters indicative of positional information, wherein the controller is operable to generate one or more drilling windows indicative of drilling tolerances of the drill plan; and a display device in communication with the controller viewable by an operator, the display device configured to display a visualization comprising the three-dimensional depiction of the most recent BHA position, the three-dimensional depiction of the drill plan, and the one or more drilling windows.

In some implementations, the one or more drilling windows has a three-dimensional rectangular prism shape. The controller is operable to generate a three-dimensional depiction of the drill plan. The controller may be operable to compare the most recent BHA position and the one or more drilling windows and display a distance between the BHA position and the one or more drilling windows on the display device. The controller may be operable to calculate a number of instances that the BHA is positioned within the one or more drilling windows throughout the drilling operation. The controller may be operable to calculate a key performance indicator (KPI) based on a length of a wellbore drilled with the BHA that is within the one or more drilling windows compared to a total length of the wellbore.

The foregoing outlines features of several implementations so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the implementations introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112(0 for any limitations of any of the claims herein, except for those in which the claim expressly uses the word "means" together with an associated function.

What is claimed is:

1. A method of directing the operation of a drilling system, comprising:

generating, with a controller, a plurality of drilling windows around a portion of a drill plan, each of the plurality of drilling windows having a shape with an outer boundary representing drilling tolerances at a particular location along the drill plan;

drilling with a bottom hole assembly comprising a bit disposed at an end of a drill string to create a drilled bore;

receiving sensor data from one or more sensors by electronic communication, the one or more sensors adjacent to or carried on the bottom hole assembly;

determining, with the controller, a position of the bottom hole assembly based on the received sensor data, wherein the received sensor data is associated with an orientation of a toolface, and wherein determining the position of the bottom hole assembly comprises determining the orientation of the toolface;

determining, with the controller the determined position of the bottom hole assembly is within the outer boundary of one window of the plurality of drilling windows;

generating, with the controller, a corrective action to move the bottom hole assembly into one of the plurality of drilling windows if the controller determines that the bottom hole assembly is not within the outer boundary of one of the plurality of drilling windows;

displaying, on a display device, a first drilling window of the plurality of drilling windows at a first location along the drill plan and a second drilling window of the plurality of drilling windows at a second location different than the first location along the drill plan; and displaying, on the display device, the position of the bottom hole assembly relative to the first and second drilling windows and using the position of the bottom hole assembly relative to the first and second drilling windows as a reference to change the position of the bottom hole assembly.

2. The method of claim 1, further comprising displaying the position of the bit relative to the plurality of drilling windows on a three-dimensional display.

3. The method of claim 2, further comprising generating the plurality of drilling windows with a three-dimensional extruded rectangle shape.

4. The method of claim 1, wherein the plurality of drilling windows are generated with a rectangular shape having a width to represent a horizontal drilling tolerance and a height to represent a vertical drilling tolerance at the portion of the drill plan around which the plurality of drilling windows are generated.

5. The method of claim 1, further comprising calculating, with the controller, a number of instances that the bottom hole assembly is within the outer boundary of the plurality of drilling windows along the drill plan.

6. The method of claim 5, further comprising displaying, with the display device, a key performance indicator comprising a percentage of distance that the bottom hole assembly is within the outer boundary of the plurality of drilling windows along the drill plan.

7. A drilling apparatus comprising:

a drill string comprising a plurality of tubulars and a bottom hole assembly (BHA) operable to perform a drilling operation;

a sensor system disposed on the drilling apparatus related to a position of the BHA, the sensor system configured to detect one or more measurable parameters of a drilled wellbore and transmit sensor data to a controller, wherein the sensor data is associated with a toolface angle;

the controller in communication with the sensor system configured to process the sensor data and determine the position of the BHA, comprising determining the toolface angle, wherein the controller is operable to generate a visualization comprising a plurality of drilling windows representing drilling tolerances of a drill plan of the drilling operation and a depiction of a location of the drill string based on the one or more measurable parameters of the drilled wellbore, and wherein the controller is configured to generate a corrective action to move the BHA into one of the plurality of drilling windows if the controller determines that the BHA is not within an outer boundary of one of the plurality of drilling windows; and a display device in communication with the controller, the display device configured to display to an operator a visualization comprising the depiction of the location of the drill string and a first and a second drilling window of the plurality of drilling windows, wherein the first and second drilling windows are displayed at different locations along the drill string, the display device operable to be used to compare the position of the BHA relative to the first and second drilling windows as a reference to change the position of the BHA.

8. The drilling apparatus of claim 7, wherein the one or more measurable parameters of the drilled wellbore comprise an inclination measurement, an azimuth measurement, a toolface angle, and a hole depth.

9. The drilling apparatus of claim 7, wherein the controller is further operable to generate a three-dimensional depiction of the drill plan, wherein the visualization further comprises the depiction of the drill plan.

10. The drilling apparatus of claim 7, wherein the plurality of drilling windows have a three-dimensional extruded rectangle shape.

11. The drilling apparatus of claim 7, wherein the controller is operable to calculate a number of instances that the drill string is within the plurality of drilling windows throughout the drilling operation.

12. The drilling apparatus of claim 11, wherein the controller is operable to calculate a key performance indicator (KPI) based on a length of the drilled wellbore within the plurality of drilling windows compared to a total length of the drilled wellbore.

13. An apparatus for steering a bottom hole assembly (BHA) comprising:

a controller configured to receive data from a sensor system disposed on the apparatus, the sensor data associated with a toolface angle and representing a drill plan of a drilling operation and measured parameters indicative of positional information of the BHA in a down hole environment, the controller is further configured to process the sensor data and determine a position of the BHA, wherein the controller is operable to generate a three-dimensional depiction of a most recent BHA position based on the measured parameters indicative of positional information, wherein the controller is operable to generate a plurality of drilling windows indicative of drilling tolerances of the drill plan, and wherein the controller is configured to generate a corrective action to move the BHA into one of the plurality of drilling windows if the controller determines that the BHA is not within an outer boundary of one of the plurality of drilling windows; and a display device in communication with the controller viewable by an operator, the display device configured to display a visualization comprising the three-dimensional depiction of the most recent BHA position, the three-dimensional depiction of the drill plan, and a first and a second drilling window of the plurality of drilling windows, wherein the first and second drilling windows are displayed at different locations along the drill string, the display device operable to be used to compare the position of the BHA relative to the first and second drilling windows as a reference to change the position of the BHA.

14. The apparatus of claim 13, wherein the plurality of drilling windows has a three-dimensional rectangular prism shape.

15. The apparatus of claim 13, wherein the controller is operable to generate a three-dimensional depiction of the drill plan.

16. The apparatus of claim 13, wherein the controller is operable to compare the most recent BHA position and the plurality of drilling windows and display a distance between the BHA position and the plurality of drilling windows on the display device.

17. The apparatus of claim 13, wherein the controller is operable to calculate a number of instances that the BHA is positioned within the plurality of drilling windows throughout the drilling operation.

18. The apparatus of claim 17, wherein the controller is operable to calculate a key performance indicator (KPI) based on a length of a wellbore drilled with the BHA that is within the plurality of drilling windows compared to a total length of the wellbore.

* * * * *